US008449246B1

(12) United States Patent
Liang

(10) Patent No.: US 8,449,246 B1
(45) Date of Patent: May 28, 2013

(54) BOAS WITH MICRO SERPENTINE COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 422 days.

(21) Appl. No.: 12/957,912

(22) Filed: Dec. 1, 2010

(51) Int. Cl.
*F01D 5/18* (2006.01)
*F01D 11/08* (2006.01)

(52) U.S. Cl.
USPC ..... 415/115; 415/173.1

(58) Field of Classification Search
USPC ..... 415/115, 116, 173.1
See application file for complete search history.

(56) References Cited

U.S. PATENT DOCUMENTS 6,705,831 B2 * 3/2004 Draper ..... 415/115
7,621,719 B2 * 11/2009 Lutjen et al. ..... 415/173.1
2007/0227706 A1 * 10/2007 Lutjen et al. ..... 165/109.1

* cited by examiner

*Primary Examiner* — Dwayne J White
(74) *Attorney, Agent, or Firm* — John Ryznic

(57) ABSTRACT

A BOAS segment for a turbine of a gas turbine engine where the BOAS segment includes an arrangement of micro sized serpentine flow cooling channels that cover the entire BOAS surface, with each serpentine channel discharging into break out holes that open onto the four sides of the BOAS in diffusion openings. The serpentine channels on the leading edge side are shorter while the serpentine channels for the trailing edge are longer because of the different metal temperature.

10 Claims, 3 Drawing Sheets

BOAS WITH MICRO SERPENTINE COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically to a blade outer air seal with cooling.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

The turbine rotor blades rotate within a surface formed by a BOAS (Blade Outer Air Seal) which forms a gap with the blade tips. The BOAS is formed of many segments secured within a ring carrier. A hot gas flow leakage that passes through the gap not only decreases the turbine efficiency but also creates hot spots on the BOAS that result in erosion or other thermal induced damage for a short part life. Especially for an IGT engine, a short BOAS life due to thermal damage is a major problem.

BRIEF SUMMARY OF THE INVENTION

A blade outer air seal (BOAS) for a turbine in a gas turbine engine in which the BOAS includes a number of micro sized serpentine flow cooling channels spaced around the four sides which together cover the entire surface of the BOAS to provide convection cooling. The hotter leading edge side of the BOAS is cooled with shorter micro channels than the relatively cooler trailing edge side. Each micro channel includes an inlet end that opens onto the backside surface so that the impingement cooling air is used to supply the micro channels, and each micro channel includes a breakout hole that opens onto the sides of the BOAS to discharge cooling air into the BOAS gaps.

DETAILED DESCRIPTION OF THE INVENTION

Figure 1:
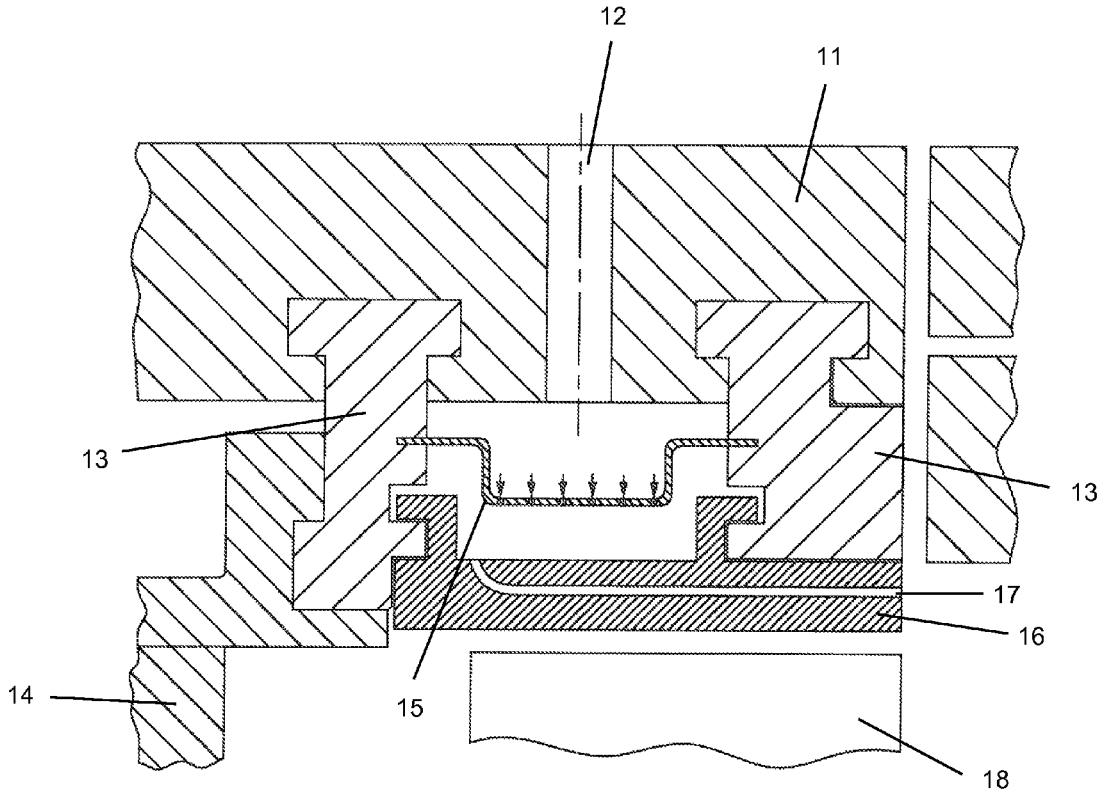
FIG. 1 shows a cross section view of a BOAS of the present invention secured within a ring carrier.

The BOAS of the present invention is shown in FIGS. 1 through 4 and includes an arrangement of micro sized serpentine flow cooling channels formed in four sections for each of the four sides of the BOAS to provide cooling to each of the four sides. FIG. 1 shows the BOAS 16 with one of the longer micro sized serpentine flow cooling channels 17. The BOAS 16 is secured to a vane carrier 11 by two isolation rings 13. An impingement ring 15 is secured to the isolation rings 13 and includes an array of impingement cooling holes to provide impingement cooling to the backside surface of the BOAS 16. A stator vane 14 is located adjacent to a rotor blade 18 that rotates within the BOAS segments. A cooling air supply channel 12 is formed within the vane carrier 11 to supply cooling air for the BOAS.

Figure 2:
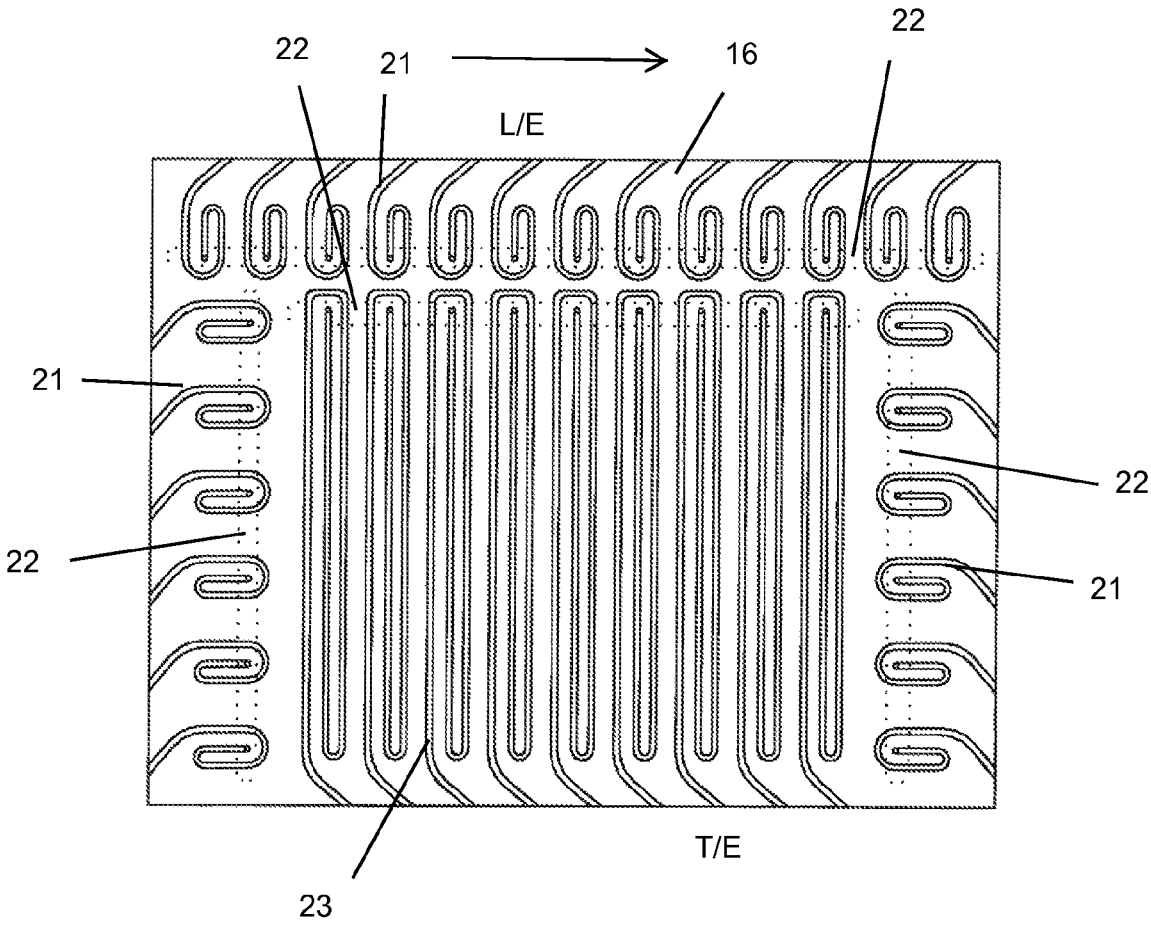
FIG. 2 shows a cross section top view of the BOAS with an arrangement of micro sized serpentine flow cooling channels of the present invention.
Figure 3:
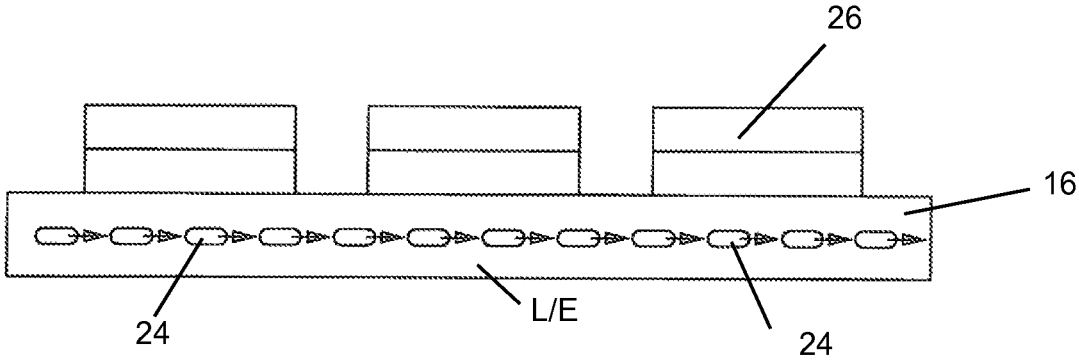
FIG. 3 shows a side view of a side view of the leading edge side of the BOASD with a row of breakout holes.

FIG. 2 shows an arrangement of micro cooling channels on the BOAS. The BOAS 16 includes four sides with a leading edge (L/E) side on top in the figure and a trailing edge (T/E) side on the bottom. The L/E side of the BOAS 16 is exposed to the highest temperature than is the T/E side and therefore the micro cooling channels 21 are shorter on the L/E side. The other two sides have micro channels 21 of similar lengths. The T/E side micro cooling channels 23 are longer and extend from the T/E side to the micro cooling channels 21 on the L/E side. Each of the sets of micro cooling channels is connected to cooling supply grooves 22 that extend substantially parallel to the respective side of the BOAS. The micro cooling channels include break out holes that open onto the respective side of the BOAS and discharge the cooling air. The micro sized serpentine flow cooling channels for this embodiment are three pass serpentine channels with an angled break out hole. In other embodiments, the serpentine channels could be other numbers of passes. FIG. 3 shows the L/E side of the BOAS with a row of the break out holes 24 that have a length greater than a height due to the hole being angled at the side surface. Front hooks 26 are shown in FIG. 3 that secure the BOAS to the isolation rings 13.

Figure 4:
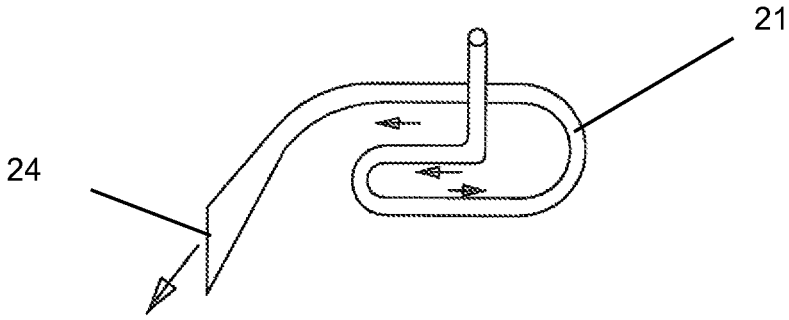
FIG. 4 shows an isometric view of one of the micro sized serpentine flow cooling channel used in the BOAS of the present invention.

FIG. 4 shows one of the shorter micro sized serpentine flow cooling channels 21 used along the OL/E side and the adjacent side of the BOAS. The micro serpentine channel 21 includes an inlet that opens on to the backside of the BOAS and an outlet end with the break out hole 24 having a diffuser shape. The inlet end is normal to the serpentine channels of the three pass serpentine flow channel 21. The outlet end is angled (on the L/E and T/E sides) from the last leg of the serpentine in a direction of the hot gas flow across the BOAS as represented by the arrow in FIG. 2.

The micro sized serpentine flow cooling channels of the BOAS of the present invention are micro sized so that more effective surface area is used for the cooling channels that will result in more cooling capability. The micro channels used for the entire BOAS will greatly reduce the main body metal temperature and therefore reduce the cooling air flow requirement and improve the turbine stage performance. Use of the four cooling air supply grooves for each of the four sides of the BOAS will enable a better distribution of cooling air for each of the four sections of the BOAS in order to account for variation of the gas side pressure and heat loads.

The micro sized serpentine flow cooling channels can be formed using quartz rods cast into the BOAS and the leached away. Instead of using stiff and brittle ceramic cores to form the cooling channels, the quartz rods can be easily bent into any desired shape. Each cooling channel can be formed with a quartz rod formed into the desired shape and then the BOAS cast around the rods to form the cooling channels.

Shorter serpentine flow channels are used on the LIE side and adjacent sides of the BOAS due to low cooling air to gas side pressure. Due to a lower gas side discharge pressure, longer channels can be used for the T/E side. Convection cooling is metered through the cooling air supply holes that open into the cooling supply grooves and then serpentine through the channels to provide cooling for the entire BOAS before being discharged through the thin diffusion slots to provide peripheral edge cooling for the BOAS.

I claim the following:

1. A BOAS segment for a turbine of a gas turbine engine, the BOAS segment comprising a leading edge side and a trailing edge side;

a first row of micro sized serpentine flow cooling channels arranged along the leading edge side;

a second row of micro sized serpentine flow cooling channels arranged along the trailing edge side;

the first row of micro sized serpentine flow cooling channels being shorter than the second row of micro sized serpentine flow cooling channels so that adequate cooling of the leading edge side of the BOAS is produced; and, the second row of micro sized serpentine flow cooling channels extending from the trailing edge side to the first row of micro sized serpentine flow cooling channels.

2. The BOAS of claim 1, and further comprising:

each of the micro sized serpentine flow cooling channels includes channels that form the serpentine flow passage parallel to the BOAS and an inlet section perpendicular to the BOAS and opening on the backside surface of the BOAS.

3. The BOAS of claim 2, and further comprising:

each of the micro sized serpentine flow cooling channels includes an outlet end angled in a direction of a hot gas flow across the BOAS from a last leg of the serpentine flow channels that opens onto a respective side of the BOAS.

4. The BOAS of claim 1, and further comprising:

each of the micro sized serpentine flow cooling channels includes an outlet end angled in a direction of a hot gas flow across the BOAS from a last leg of the serpentine flow channels that opens onto a respective side of the BOAS.

5. The BOAS of claim 2, and further comprising:

the serpentine flow channel is a three-pass serpentine flow channel.

6. The BOAS of claim 1, and further comprising:

a third and a fourth row of micro sized serpentine flow cooling channels located on the adjacent sides of the BOAS.

7. The BOAS of claim 6, and further comprising:

the first row of micro sized serpentine flow cooling channels extends across the entire leading edge side;

the third and fourth rows of micro sized serpentine flow cooling channels extend from the trailing edge side to the first row of micro sized serpentine flow cooling channels; and, the second row of micro sized serpentine flow cooling channels extends between the third and fourth rows from the trailing edge side to the first row of micro sized serpentine flow cooling channels such that all four rows of micro sized serpentine flow cooling channels cover the entire BOAS.

8. The BOAS of claim 1, and further comprising:

the third and fourth rows of micro sized serpentine flow cooling channels include break out holes that are angled in a direction toward the trailing edge side of the BOAS.

9. The BOAS of claim 1, and further comprising:

each row of micro sized serpentine flow cooling channels is connected to a cooling air supply groove extending along a side of the BOAS parallel to the side.

10. The BOAS of claim 9, and further comprising:

the cooling air supply groove for the second row of micro sized serpentine flow cooling channels is located adjacent to the cooling air supply groove for the first row of micro sized serpentine flow cooling channels.

* * * * *